United States Patent [19]

Izumi et al.

[11] Patent Number: 4,703,632

[45] Date of Patent: Nov. 3, 1987

[54] LINT REMOVING APPARATUS FOR CIRCULAR KNITTING MACHINE

[75] Inventors: Toshiro Izumi; Hiroyuki Ueda, both of Hyogo, Japan

[73] Assignee: Precision Fukuhara Works, Ltd., Hyogo, Japan

[21] Appl. No.: 919,759

[22] Filed: Oct. 16, 1986

[30] Foreign Application Priority Data

Oct. 28, 1985 [JP] Japan ..... 60-242282
Nov. 26, 1985 [JP] Japan ..... 60-265643

[51] Int. Cl.[4] ..... D04B 35/32
[52] U.S. Cl. ..... 66/168; 66/147
[58] Field of Search ..... 66/147, 168

[56] References Cited

U.S. PATENT DOCUMENTS 2,325,023 7/1943 Allred ..... 66/168 X
3,269,151 8/1966 Abrams et al. ..... 66/168
3,422,640 1/1969 Abrams ..... 66/168
3,783,648 1/1974 Heinrichs ..... 66/168

FOREIGN PATENT DOCUMENTS 65623 2/1969 German Democratic Rep. ... 66/168
528363 9/1976 U.S.S.R. ..... 66/168

*Primary Examiner*—Wm. Carter Reynolds
*Attorney, Agent, or Firm*—Bell, Seltzer, Park & Gibson

[57] ABSTRACT

The lint removing apparatus of the present invention is provided with at least one air jet ejecting pipe which is supported for rotation in a circular path of travel so that air is directed over and against selected portions of the knitting machine. Means is provided for supporting the air ejection pipe for rotation and drive means interconnects the rotary needle cylinder with the air ejecting pipe for rotating the air ejecting pipe in the same direction as the needle cylinder and at a decreased speed relative to the rotational speed of the rotary needle cylinder. The drive means includes a planetary gear system including a plurality of bevel gears and a bearing housing supporting the bevel gears. The bearing housing includes a lower rotatable body tube and an upper nonrotating cap.

4 Claims, 5 Drawing Figures

LINT REMOVING APPARATUS FOR CIRCULAR KNITTING MACHINE

FIELD OF THE INVENTION

This invention relates to an apparatus for blowing away and removing lint and other waste materials, such as dust and fibers, which tend to accumulate on the various portions of a circular knitting machine, such as the yarn support creel, the sinkers, the sinker bed and cap, the knitting needles, yarn feeding devices, yarn guides, yarn breakage detecting devices and the like.

BACKGROUND OF THE INVENTION

Lint, dust and waste fibers tend to accumulate on the knitting machine parts and are occasionally knitted into the fabric causing defects in the knitted fabric and, in some cases, causing damage to the knitting needles and other parts of the knitting machine. Various types of air blowing cleaning devices have been provided for blowing away and removing the lint and waste fibers before they can accumulate to the point that they cause damage to the machine and/or the knit fabric.

These known devices usually include one or more air ejecting pipes with an opening or nozzle at the outer end. These air ejecting pipes are usually rotated in the same or opposite directions to that of the revolving needle cylinder and are normally directed to blow lint and waste fibers from various locations on the knitting machine.

Japanese Patent Publication No. SHO 52-33705 discloses an arrangement of air ejecting pipes which rotate in the opposite direction to that of the revolving needle cylinder so that the speed of travel of the air ejecting pipe moving past a given location is determined by the speed of rotation of the needle cylinder plus the speed of rotation of the air ejecting pipe. Thus, the relative speed of travel of the air ejecting pipe is so fast that effective lint removal is not obtained. In an attempt to overcome this problem, it has been proposed that a plurality of air ejecting pipes be provided. However, when a plurality of air ejecting pipes is provided, the air pressure drops and thereby lowers the lint removing effectiveness of the lint removing apparatus.

SUMMARY OF THE INVENTION

With the foregoing in mind, it is an object of the present invention to eliminate the disadvantages of the prior art and to provide a lint removing air jet apparatus which is simple in construction and inexpensive to manufacture and operates in an efficient manner to remove lint and the like from various locations on the knitting machine.

To achieve this object, the lint removing apparatus of the present invention is provided with at least one air ejecting pipe which rotates in the same direction as the rotational direction of the rotary cylinder and through the open end or orifice of which air is ejected against the knitting stations spaced around the needle cylinder. Additionally, the lint removing apparatus of the present invention includes a speed decreasing device which operates to reduce the rotational speed of the air ejecting pipe below the speed of rotation of the needle cylinder. Preferably, the speed decreasing device includes intermeshing bevel gears drivingly connecting the rotating air jet with the rotary needle cylinder.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
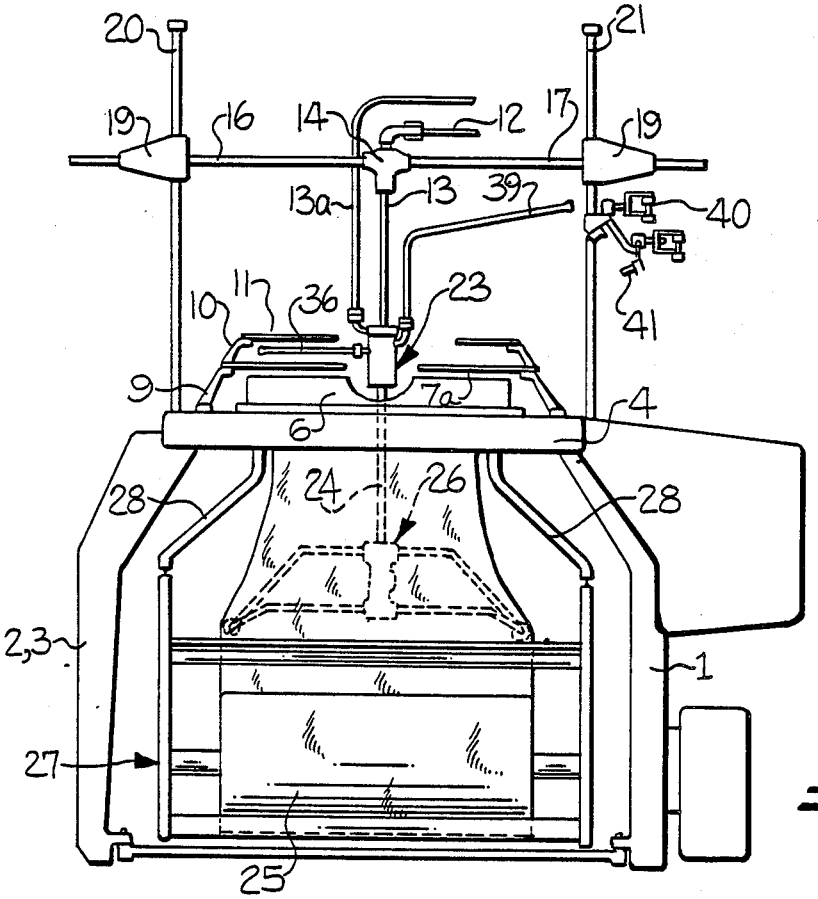
FIG. 1 is a somewhat schematic front elevational view of a circular knitting machine with the lint removing apparatus of the present invention applied thereto.
Figure 2:
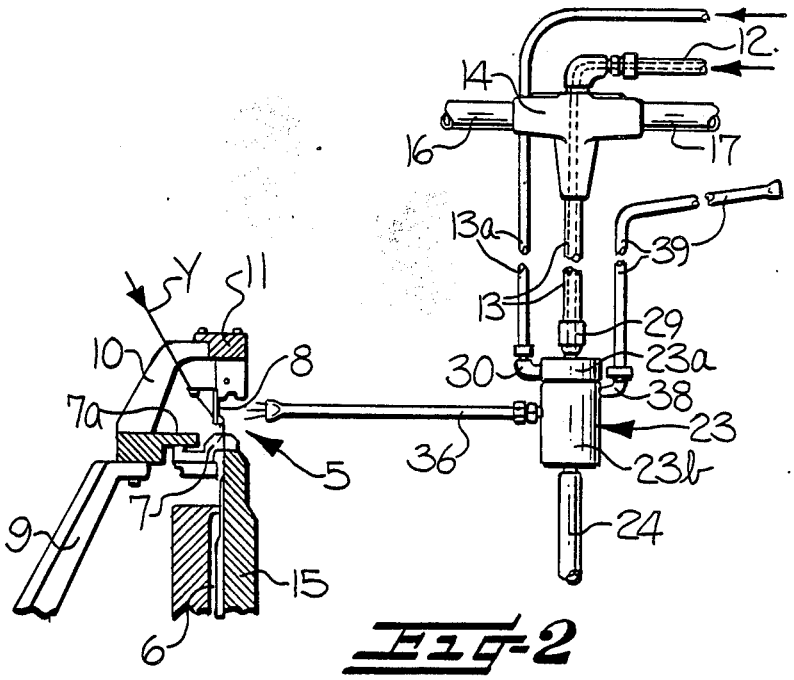
FIG. 2 is an enlarged vertical sectional view through the upper portion of the needle cylinder and illustrating the rotating air ejection pipes supported for rotation in the central portion of the needle cylinder.

As illustrated in FIG. 1, the circular knitting machine includes a plurality of knitting stations, broadly indicated at 5 in FIG. 2, positioned in spaced-apart relationship around the circular knitting machine. The knitting stations 5 are supported on a bed 4 which is in turn supported on the upper ends of legs 1, 2. A stitch cam ring 6 surrounds a rotatable needle cylinder 15 (FIG. 2).

As illustrated in FIG. 2, each of the knitting stations 5 includes suitable needle cams, not shown, supported in the cam ring 6, and a yarn carrier 8 for feeding yarn Y to the knitting needles for forming fabric therefrom in cooperation with radially movable sinkers 7. Knitting needles are supported for vertical sliding movement in the usual needle grooves formed on the outer circumference of the rotating needle cylinder 15.

The needle cylinder 15 is rotated in a given direction, for example in a counterclockwise direction, and at a substantially uniform speed in the usual manner by a ring gear, not shown, supported in the main bed plate 4. The sinkers 7 are supported for radial movement in a sinker dial carried by the needle cylinder 15 and the radial position of the sinkers is controlled by the usual cams in a sinker cap ring **7*a* supported in a fixed position on the upper ends of radially extending and spaced-apart support arms 9 with the lower portions thereof being fixed on the main bed plate 4. The yarn feed fingers 8 are supported on a yarn carrier ring 11 which is in turn supported on the upper ends of support arms 10 having their lower ends fixed on the sinker cap ring 7*a***.

The upper end of a vertically extending fixed air supply pipe 13 is supported in a support joint 14 and extends downwardly through the center of the needle cylinder 15. The upper end of the air supply pipe 13 is connected to a suitable source of compressed air, not shown, as by a supply line 12, so that air under pressure is directed downwardly through the fixed supply pipe 13. The lower end of the fixed air supply pipe 13 is attached to the upper end of a bearing housing, broadly indicated at 23, to be presently described. As will be noted in FIG. 2, the vertical position of the central portion of the bearing housing 23 is substantially the same or slightly higher than the upper end of the rotating needle cylinder 15. The support joint 14 is supported by radially extending horizontal connector rods 16, 17, and the outer ends are connected by support brackets 19 to the upper end portions of vertical support posts 20, 21, the lower ends of which are fixed on the bed plate 4 (FIG. 1). A supplemental or additional air supply line 13*a* has one end connected to the upper portion of the bearing housing 23, for purposes to be presently described, and the other end of which is connected to the source of compressed air, not shown.

The upper end of a driving and rotating shaft 24 is connected and extends into the lower portion of the bearing housing 23, for purposes to be presently described. The lower end of the rotating shaft 24 is fixed to a knit fabric spreader unit, broadly indicated at 26 in FIG. 1, for moving the circular fabric into a flattened condition to be wound onto a fabric take up roll 25, in the usual manner. The spreader unit 26 forms a part of a take up unit, broadly indicated at 27. The take up unit 27 and the spreader 26 are rotated by means of connecting rods or arms 28, the upper ends of which are fixed to the rotating gear for the needle cylinder 15, in the usual manner, so that rotation is imparted to the rotating shaft 24 at the same speed as rotation is imparted to the needle cylinder 15.

Figure 3:
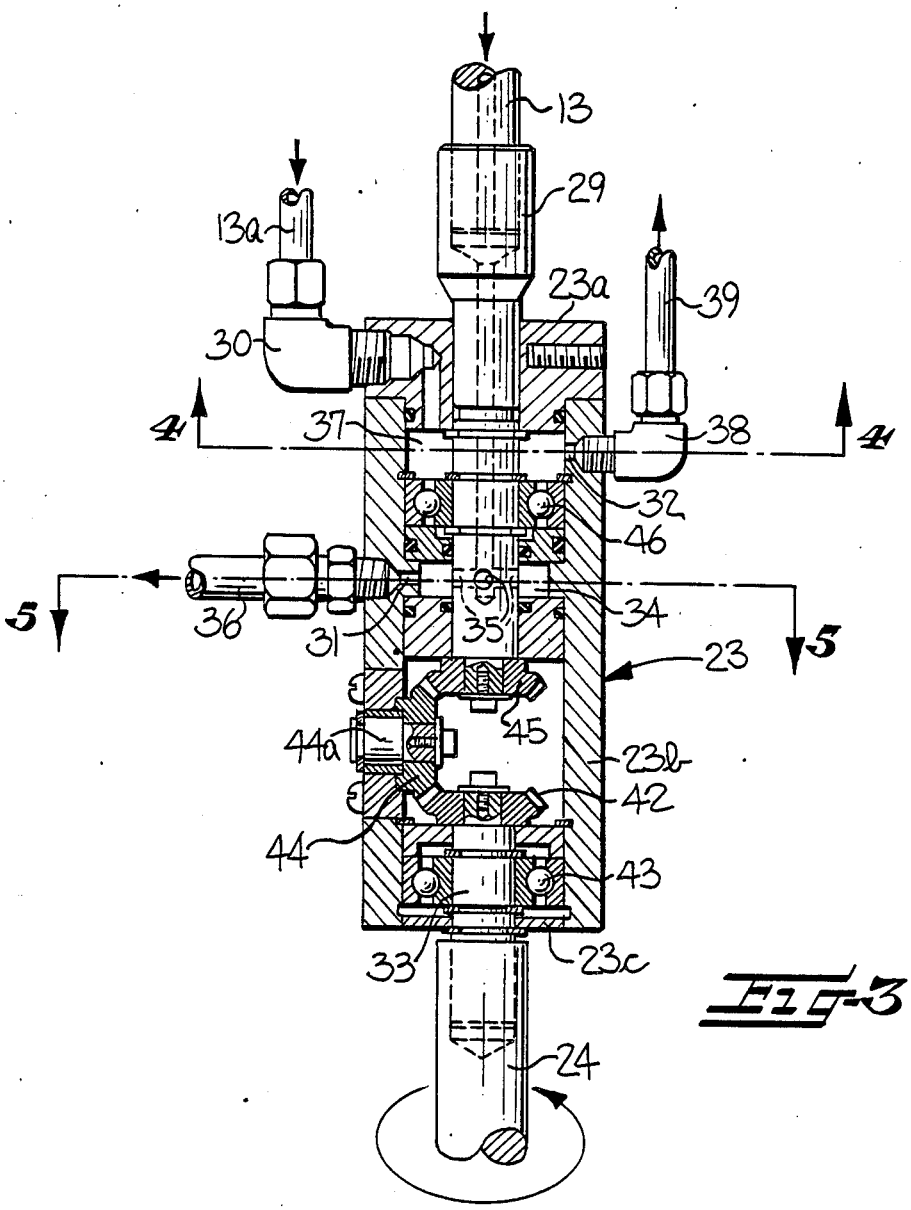
FIG. 3 is an enlarged vertical sectional view through the bearing housing of the rotating air jet device.
Figure 4:
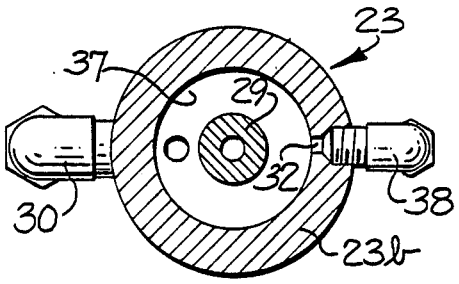
FIG. 4 is a horizontal sectional view taken substantially along the line 4—4 FIG. 3.

As shown in FIG. 3, the bearing housing 23 includes a fixed cover or cap 23*a* on the upper end thereof. The nonrotating cap 23*a* is fixed to a connector pipe 29 which is fixed at its upper end on the lower end of the air supply pipe 13. The lower end portion of the connector pipe 29 extends into the bearing housing 23, as illustrated in FIG. 3, to substantially the central portion of a rotatable lower body tube 23*b*. A joint elbow 30 is connected to the supplemental air line 13*a* and is threadably supported in the fixed upper cap 23*a* for supplying air under pressure into an annular chamber 37 surrounding the connector pipe 29. An outlet opening 32 (FIGS. 3 and 4) is provided in the rotatable body tube 23*b* and communicates with a joint elbow 38 connected to a second air ejection pipe 39. The outer end of the air ejection pipe 39 is positioned to rotate and direct ejected air against and onto tape drive type positive yarn feeding devices 40 and broken yarn end detectors 41, positioned around the knitting machine and above each of the yarn knitting stations (FIG. 1).

Figure 5:
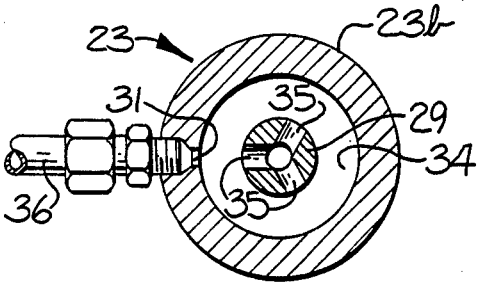
FIG. 5 is a horizontal sectional view taken substantially along the line 5—5 in FIG. 3.

The connector pipe 29 is provided with a central and longitudinally extending bore which extends downwardly to the level of an annular passage 34 and is communicatively connected therewith by radially extending openings 35. An outlet opening 31 (FIGS. 3 and 5) is provided in the annular passage 34 and is communicatively connected with a threaded nipple supporting the inner end of a first air ejection pipe 36. The outer free end of the air ejection pipe 36 is preferably flattened to somewhat dispense the air ejected therefrom into and against the yarn feed fingers, needles, and sinkers at each of the knitting stations 5, as the air ejection pipe 36 is rotated, in a manner to be presently described. Thus, air under pressure extends inwardly through the fixed pipe 13, into the annular passageway 34 and outwardly through the air ejection pipe 36 to blow lint, waste fibers and the like from the knitting machine parts.

The rotatable body tube 23*b* is rotated by means of a planetary gear system including a first bevel gear 42 fixed to the upper end of a connector shaft 33 fixed at its lower end to the upper end of the rotary drive shaft 24 and rotatably supported in a lower wall 23*c* of the rotating body tube 23*b*. The rotatable body tube 23*b* is supported for rotation on respective lower and upper ball bearings 43, 46. The first bevel gear 42 drivingly engages a second bevel gear 44 which is rotatably mounted on a stub shaft 44*a*, the outer end of which is fixed in the rotatable body tube 23*b*. A third bevel gear 45 is fixed to the bottom end of the fixed connector pipe 29 and its teeth engage the teeth of the second bevel gear 44 so that when rotation is imparted to the first bevel gear 42 by the rotary shaft 24, rotation is imparted to the rotatabe body tube 23*b* by means of the second bevel gear 44 rotating around the third bevel gear 45.

The rotating body tube 23*b* is rotated at a reduced speed, provided through adjustment of the respective number of teeth on the bevel gears 42, 44 and 45 to rotate the rotatable body tube 23*b* in the same direction as the rotary needle cylinder 15 and preferably at one-half the speed of rotation of the rotary shaft 24, and at one-half the speed of rotation of the needle cylinder 15. While the rotary body tube 23*b* is rotated by means of the planetary gear system and rotation of the rotary shaft 24, to impart rotary motion to both the air ejection pipes 36 and 39, the upper cap member 23*a* remains stationary and does not rotate.

Thus, the speed reduction system of the present invention imparts rotation to the air ejection pipes 36 and 39 to rotate the same in the same direction as the rotary needle cylinder 15 and at a reduced speed so that the relative speed of movement of the air ejection pipes 36, 39, moving past the parts of the machine upon which the air is directed, is relatively low to provide a more effective lint removal with a given amount of compressed air being utilized. The present lint removing apparatus is simple in construction and is effective for cleaning lint and waste fibers from the machine while conserving the amount of pressurized air required in the cleaning operation. Since the revolving air ejection pipes 36, 39 are drivingly connected to the same drive source as the needle cylinder 15, rotation of the air ejection pipes 36, 39 occurs when the needle cylinder is rotated and ceases when rotation of the needle cylinder 15 is stopped.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A lint removing apparatus for a circular knitting machine having a needle cylinder rotating in a given direction and at a substantially constant speed, said lint removing apparatus including at least one air ejecting pipe, means supporting said air ejecting pipe for rotation, and drive means operable in response to rotation of said needle cylinder for rotating said air ejecting pipe in the same direction as said rotary needle cylinder and at a decreased speed relative to the rotational speed of said rotary cylinder, and wherein said drive means comprises a plurality of bevel gears, and a bearing housing supporting said bevel gears, said bearing housing including a lower rotatable body tube, and an upper nonrotating cap, and wherein said air ejecting pipe is carried by said lower rotatable body tube, said drive means further including a drive shaft extending into said lower rotatable body tube and driven at the same speed as said needle cylinder, a first bevel gear fixed on said drive shaft, a second bevel gear in driving engagement with said first bevel gear and rotatably supported on said lower rotatable body tube, and a third bevel gear meshing with said second bevel gear and being fixed in a nonrotating position in said lower rotatable body tube.

2. A lint removing apparatus according to claim 1 wherein said drive means rotates said air ejecting pipe at substantially one-half the speed for rotation of said needle cylinder.

3. A lint removing apparatus according to claim 1 wherein said knitting machine includes spaced-apart knitting stations positioned around said needle cylinder, and yarn feeders and broken yarn end detectors positioned above said knitting stations, and wherein said lint removing apparatus includes a first rotating air ejecting pipe directing air against said knitting stations.

4. A lint removing apparatus according to claim 3 including a second rotating air ejecting pipe directing air against said yarn feeders and broken yarn end detectors.

* * * * *